US010682284B2

(12) United States Patent
Carson et al.

(10) Patent No.: US 10,682,284 B2
(45) Date of Patent: Jun. 16, 2020

(54) PILL DISPENSING APPARATUS AND METHOD FOR AUTOMATICALLY DISPENSING PILLS

(71) Applicants: Thomas Eric Carson, Modesto, CA (US); Edwin C. Simpson, Stockton, CA (US); Mary Carson, Modesto, CA (US)

(72) Inventors: Thomas Eric Carson, Modesto, CA (US); Edwin C. Simpson, Stockton, CA (US); Mary Carson, Modesto, CA (US)

( * ) Notice: Subject to any disclaimer, the term of this patent is extended or adjusted under 35 U.S.C. 154(b) by 3 days.

(21) Appl. No.: 15/981,219

(22) Filed: May 16, 2018

(65) Prior Publication Data

US 2018/0333335 A1 Nov. 22, 2018

Related U.S. Application Data

(60) Provisional application No. 62/507,914, filed on May 18, 2017.

(51) Int. Cl.

| | |
|---|---|
| ***A61J 7/04*** | (2006.01) |
| ***G07F 11/46*** | (2006.01) |
| ***A61J 1/03*** | (2006.01) |
| ***A61J 7/00*** | (2006.01) |

(52) U.S. Cl.

CPC ..... *A61J 7/0436* (2015.05); *A61J 1/035* (2013.01); *A61J 7/0076* (2013.01); *A61J 7/0084* (2013.01); *A61J 7/0418* (2015.05); *A61J 7/0454* (2015.05); *A61J 7/0481* (2013.01); *G07F 11/46* (2013.01); *A61J 2200/30* (2013.01); *A61J 2205/20* (2013.01); *A61J 2205/70* (2013.01)

(58) Field of Classification Search

USPC ..... 700/236

See application file for complete search history.

(56) References Cited

U.S. PATENT DOCUMENTS

| | | | | |
|---|---|---|---|---|
| 4,798,309 | A | 1/1989 | Stone | |
| 4,911,327 | A | 3/1990 | Shepherd | |
| 5,291,191 | A | 3/1994 | Moore | |
| 6,189,727 | B1 * | 2/2001 | Shoenfeld | G07F 13/10 221/2 |
| 6,332,100 | B1 | 12/2001 | Sahai | |
| 6,988,619 | B2 * | 1/2006 | Klatt | A61J 1/035 206/232 |
| 8,453,874 | B2 | 6/2013 | Simpson | |
| 2004/0182873 | A1 | 9/2004 | Baum | |
| 2009/0105876 | A1 * | 4/2009 | Simpson | A61J 7/0084 700/242 |
| 2013/0035785 | A1 * | 2/2013 | MacVittie | B65D 83/0409 700/231 |

(Continued)

OTHER PUBLICATIONS

International Preliminary Report on patentability and Written Opinion in PCT/US05/31241, dated Mar. 6, 2007, pp. 1-4.

(Continued)

*Primary Examiner* — Jacob S. Scott
*Assistant Examiner* — Ayodeji T Ojofeitimi
(74) *Attorney, Agent, or Firm* — Jeffrey S. Melcher; Melcher Patent Law PLLC

(57) ABSTRACT

Provided is a pill dispensing apparatus that automatically dispenses pills to patients. Also provided is a method of automatically dispensing pills to patients.

19 Claims, 13 Drawing Sheets

(56) References Cited

U.S. PATENT DOCUMENTS

2013/0079925 A1* 3/2013 Alaklabi ..... G06F 19/3462
700/236
2014/0103060 A1* 4/2014 Kim ..... G07F 11/42
221/76

OTHER PUBLICATIONS

Written Opinion in PCT/US05/31241, dated Aug. 18, 2006 , pp. 1-3.

* cited by examiner

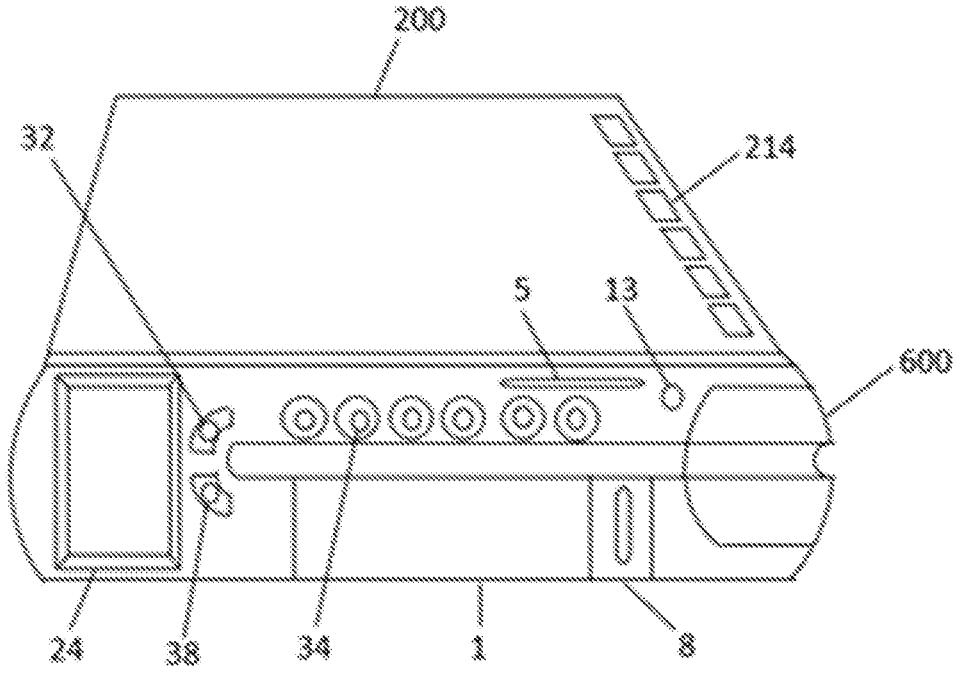
Fig. 1A
Fig. 2A
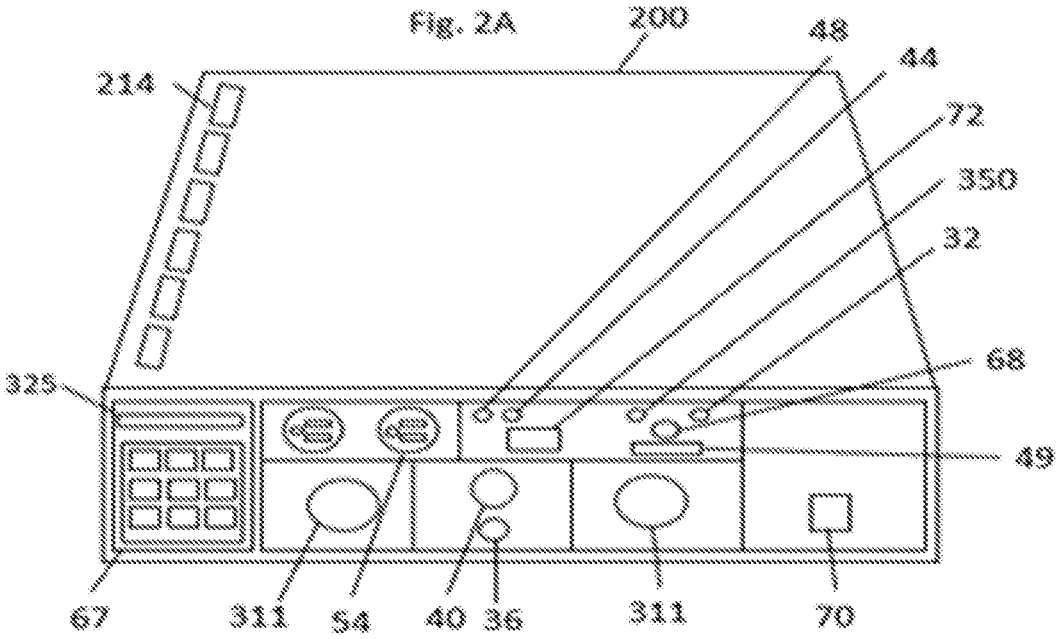

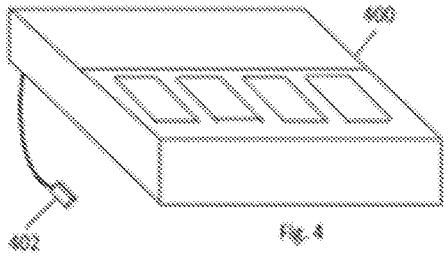
Fig. 4
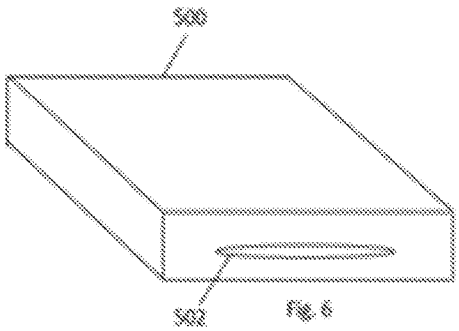
Fig. 6
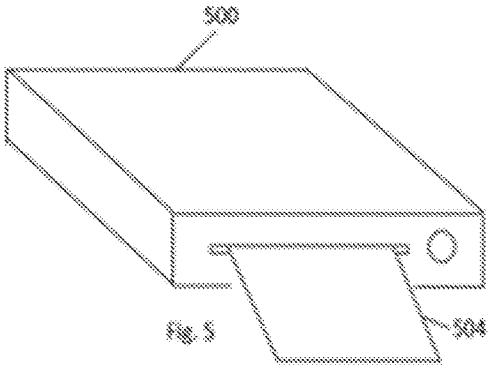
Fig. 5
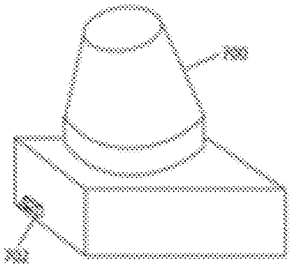
Fig. 7
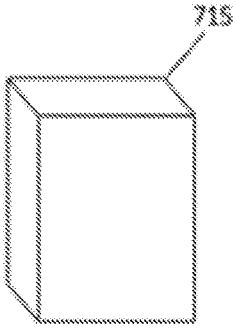
Fig. 10
Fig. 8
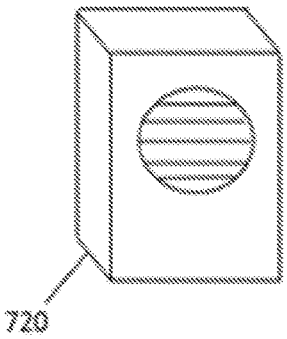
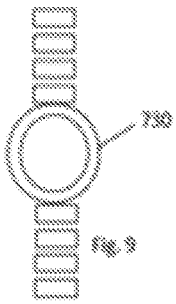
Fig. 9

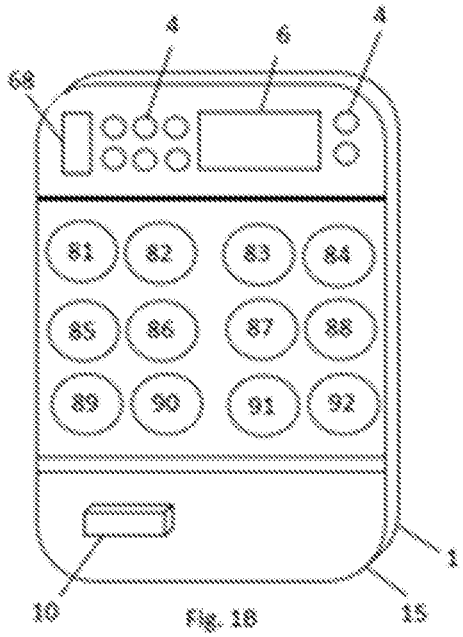
Fig. 1B
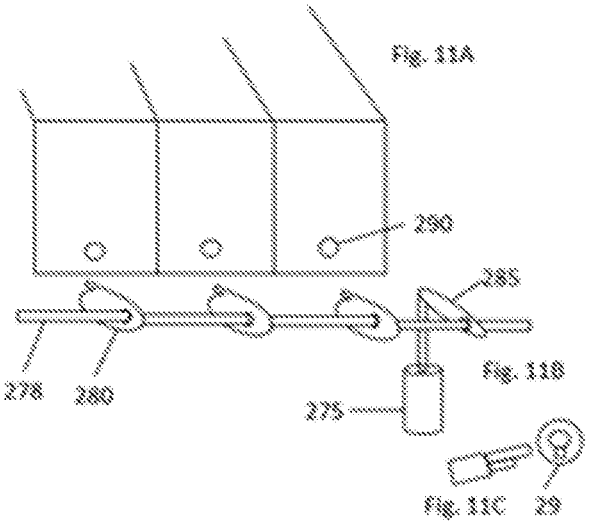
Fig. 2B
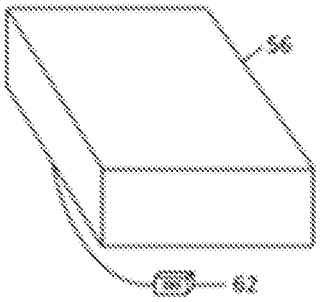
Fig. 2C
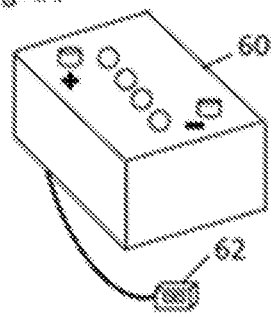
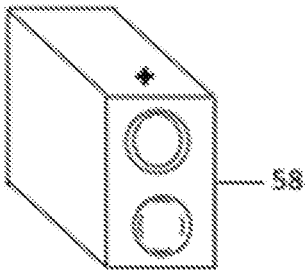
Fig. 2E
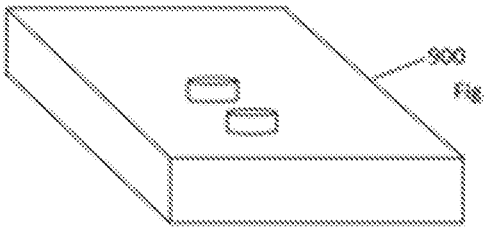
Fig. 2D

PILL DISPENSING APPARATUS AND METHOD FOR AUTOMATICALLY DISPENSING PILLS

FIELD OF THE INVENTION

The invention relates to a pill dispensing apparatus and method for automatically dispensing pills to patients. The invention also relates to a method of automatically dispensing pills to patients.

BACKGROUND OF THE INVENTION

Published statistics show that approximately 98,000 people die and 770,000 are injured due to mistakes made in hospital and care facilities in the United States each year. U.S. government agencies are presently in the process of working on legislation to force change and put safeguards in place in this industry. Presently, there is no pill dispensing apparatus that solves these problems.

Published U.S. patent application 2001/0028308-A1 FIGS. 2-17 shows a pill container or vial hooked to a personal home computer or hospital or nursing home computer that alerts the patient when to take the medication but has no control over how many pills the patient takes. With open access to as many as you want the record keeping is of no use if the patient is dead. Also, the patient must have a personal computer. FIGS. 18-25 show a device that cannot handle a packaged pill and the personal computer can be reprogrammed at any time for more pills at the wrong time and combination. FIGS. 26-27 show access to a series of vials with the same results as FIGS. 2-17. FIG. 29 shows vials upside down on a dispensing unit with a slide (#885 Sheet 15). This device will not work or handle different size pills or packaged pills. FIGS. 31-34 show a tape tear off by hand hooked to the personal computer which can be reprogrammed for more and anytime delivery. FIGS. 35-39 show a small device on a pill container that when open the patient can take as many pills as they want. FIG. 41 shows a liquid dispenser that can be programmed as the patient wishes. FIG. 4-46 shows a small processor which gives access to the vial/container for consumption to as many pills as the patient wants FIGS. 51-70 all give access to any amount of pills left in the vial. Must have a software program to transfer information to computer. The memory strip in these device, does count and record, when the vial is out, but the patient can take as many pills as desired. This device will not work on odd shape or different size pills. The contacts on the device can count the number of times the vial is opened but has no control over how many pills are taken. Patient can change time of pill dose forward or backward. Separate machine to be portable.

U.S. Pat. No. 4,573,606 discloses a device in which the patient preloads the twelve storage compartments for the upcoming 24 hour period. Patient loading errors on amount and type of dispensed pills is a real problem. The cartridge can be manually rotated (5-35) to take any amount any time. The dispensing time is not flexible. Settings are: Every Two Hours, Every Four Hours, Every six Hours, Every Twelve Hours. This device cannot handle packaged pills.

U.S. Pat. No. 4,640,560 discloses a device that holds only one week of pills. All pill containers can be removed at will when desired by the patient. There is no overdose protection and the device will not handle packaged pills.

U.S. Pat. No. 4,490,711 discloses a device is basically a hand carry day planner with a small compartment to hold four types of pills for a single day. This device has no safe guards to insure the correct pill is taken at the correct time. The timer has limited settings of on the hour or ½ hour not both or anything in between. It cannot skip a day or days and is good for one day only.

U.S. Pat. No. 5,159,581 discloses a device in which the patient must reach into a small compartment to retrieve the pill (FIG. 1). The device holds 1 week supply of pills only and is microprocessor limited to four times a day. The device provides a difficult and clumsy way to reset base plates (FIGS. 8 & 9). The device will not handle packaged pills.

U.S. Pat. No. 5,392,952 discloses a device designed for home setting only. To take a pill the patient must push the dispense button. The description of portable to this device is to drop all pills for the day in a single portable container, which may be taken all at one time, any sequence, all at wrong time, with or without food if directed. The program must be loaded into the controller serial port #238 by external computer, external keyboard or keypad #220, card reader #222, phone port #232, or signal transmitter to remote receiver. This device has no safety guards against taking the wrong pill at the wrong time. The patient may change time and quantity at will. The device will not handle packaged pills.

U.S. Pat. No. 5,646,912 discloses a device that stores only one type of pill in the dispenser (FIG. 2). The pill dispensers are all the same shape and size, whereas pills come in hundreds of shapes and sizes. They do not stack or align themselves for single or multiple pill delivery. Even if some non-existing method of separating the pills was available the arthritic fingers of the patient could not open the door and retrieve the pills. This device will not handle packaged pills.

U.S. Pat. No. 5,710,551 discloses a medication monitoring system that can only be used with a computer central monitoring system. The system holds only one week's supply of pills. pills are available from a container with a hinged or removable lid with no control of how many pills can be taken. The device will not handle packaged pills.

U.S. Pat. No. 5,751,661 discloses a device that fits on the cap of the pill container and measures the time between the openings of the cap. There are no safe guards to prevent the patient from taking the wrong pill, wrong amount, at the wrong time. In the case of a habit-forming drug the patient can take them as often as they like. This device will not handle packaged pills.

U.S. Pat. No. 6,314,384 B1 discloses a portable reminding unit and the patient must have a pc type computer to operate it. This device will not handle packaged pills.

U.S. Pat. No. 6,322,100 B1 discloses a medication dispensing system in which the patient must press a button within a prescribed time to dispense a canister or canisters. Then the patient must open the canisters to retrieve the pills. (FIG. 3) The system holds only one week of medication. The patient can take as many pills as are in the canister and, thus, overdose is easy. This device will not handle packaged pills.

U.S. Pat. No. 6,510,962 B1 discloses a device having a 24 cavity storage wheel. The electronic system actuates two vanes at each signal so the system is only good for 12 days. The patient can manually advance the wheel any time desired to take additional pills. This device will not handle packaged pills.

My U.S. Pat. No. 8,453,874 discloses a pill dispensing device, the complete disclosure of which is incorporated herein by reference.

The prior art devices do not prevent overdose or wrong medication. There is a great need to provide a pill dispensing device that prevents patient overdose or wrong medication.

SUMMARY OF THE INVENTION

Prior art in the dispensing of medication had as its design criteria the dispensing of loose pills. With medication compliance now a priority in home, hospital, and care facility the professional code states that medicine administered to the patient must be in a package with description of the drug, date, strength, bar code, etc. As more and more states adopt the new rules the need for a dispensing machine that can handle loose or packaged pills is a must. We have included a system for complying with prescribed medication dosing requirements with safeguards to insure the right pill at the right time.

The present pill dispensing apparatus was developed to correct the problems that currently exist in the professional setting as well as in the home. Unlike any machine presently on the market, the present pill dispensing machine is designed to be loaded and programmed by a professional pharmacist, nurse or doctor. Research has shown that it would actually cost very little and save the pharmacy considerable time and money by using the present pill dispensing machine. According to the latest reports, labor savings in this area is a major concern due to a nationwide shortage of pharmacists. We have, however, built the pill dispensing apparatus so that, if a pharmacy were unwilling to dispense the medications in the way best suited to the machine, a self-load system is also designed into the pill dispensing apparatus that overrides the need for professional loading.

We have also made it a priority to build the pill dispensing apparatus to be extremely user friendly. Procedures necessary to set the pill dispensing apparatus have been kept clean and simple should the need for non-professional loading arise. It is our hope, however, that this procedure would be one done by the professional and that a number of benefits in the entire industry would come to pass due to the pill dispensing apparatus' acceptance. The pill dispensing apparatus is preferably not a computer and does not require computer technology of knowledge to fill or to operate. The patient who uses the pill dispensing apparatus needs only the mental and physical capacity to get a glass of water, take the pills from the delivery trough and swallow them. The pill dispensing apparatus eliminates the need for the patient or caregiver to keep track of medications.

Hospitals, health care facilities, state disease control, organ transplant recipients, to name a few, are required to have proper documentation of medicine ingestion as part of their record keeping. The pill dispensing apparatus supplies paper printouts of pill dispensing in the format called for by each facility. Generally, for home use this option would not be necessary and the apparatus could be obtained without this option. The apparatus is designed to be fully loaded with all the options available or stripped down to an economy model according to the needs of the patient.

These objectives are met by a pill dispensing apparatus comprising: at least one cartridge constructed and arranged to dispense packaged pills; a pill dispenser constructed and arranged to removably receive at least one cartridge, the pill dispenser having a pill collector constructed and arranged to collect pills dispensed from the at least one cartridge; a low pill sensor constructed and arranged to sense a number of pills remaining in the cartridge; a pill collector sensor constructed and arranged to signal when a patient has removed a pill from the pill collector; and a controller constructed and arranged to control the rate and number of pills to be dispensed from the at least one cartridge to the pill collector, the controller comprising a timer having inputs for inputting the day and time of day for dispensing pills from the cartridge, the controller being in communication with the low pill sensor to provide an alert when the number of pills is low or last remaining pill is present in the cartridge, the controller being in communication with the pill collector sensor to provide an alert when a pill has remained in pill collector beyond a set time period, and the controller being constructed and arranged to provide an alert when a pill is dispensed into the pill collector.

These objectives are also met by a method of automatically dispensing pills comprising: loading at least one cartridge with pills, the cartridge constructed and arranged to dispense the pills; installing the cartridge containing pills onto a pill dispenser constructed and arranged to removably receive the cartridge, the pill dispenser having a pill collector constructed and arranged to collect pills dispensed from the at least one cartridge, a low pill sensor constructed and arranged to sense a number of pills remaining in the cartridge, and a pill collector sensor constructed and arranged to signal when a patient has removed a pill from the pill collector; setting a timer on a controller to control the rate and number of pills to be dispensed from the at least one cartridge to the pill collector, the controller being in communication with the low pill sensor, the controller being in communication with the pill collector sensor; alerting a patient when a pill has been dispensed into the pill collector; providing an alert when a dispensed pill has not been removed from the pill collector after a set time period; and providing an alert when the number of pills remaining in the cartridge is low or on last pill.

BRIEF DESCRIPTION OF THE DRAWINGS

FIGS. 1A-2A illustrate side views of a controller.

FIG. 2B illustrates a view of power inverter.

FIG. 2C illustrates a view of a battery.

FIG. 2D illustrates a view of a stop/start timer.

FIG. 2E illustrates a view of a backup battery.

FIG. 4 illustrates a view of an emergency automatic telephone dialer.

FIGS. 5 and 6 illustrate views of a printer.

FIG. 7 illustrates a view of a strobe light.

FIG. 8 illustrates a view of a pager.

FIG. 9 illustrates a view of a shaker wristwatch.

FIG. 10 illustrates a view of a belt shaker.

FIGS. 11A-11C illustrates a lock that locks all of the cartridges in place.

DETAILED DESCRIPTION OF PREFERRED EMBODIMENTS

Figure 1C:
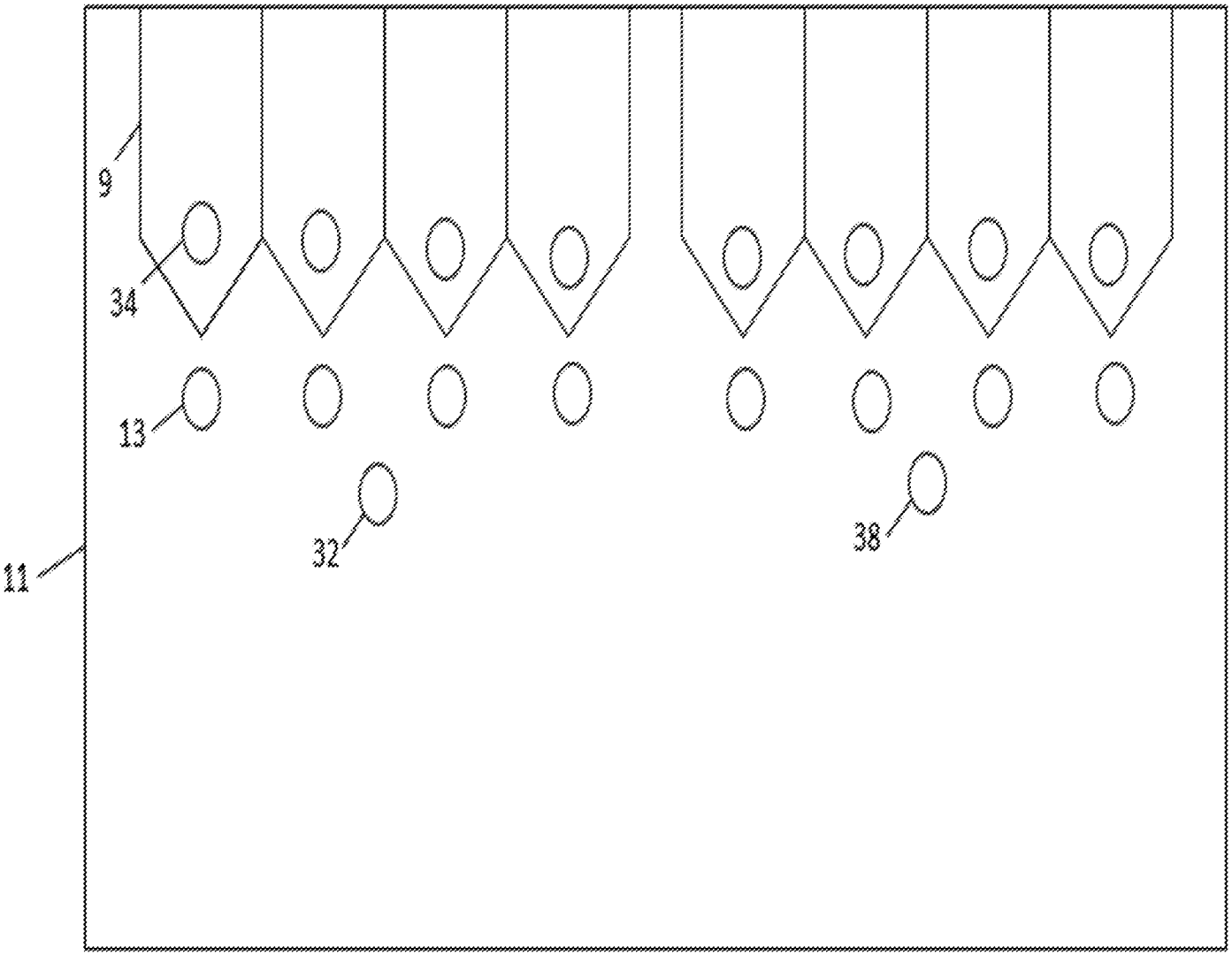

The pills dispensing apparatus will now be described with reference to the attached Figures without being limited thereto.

In a controlled hospital or professional care setting, each patient can be assigned a pill dispensing apparatus when they enter the hospital facility. As part of the regular admittance to routine a pill dispensing apparatus is set up through already existing procedures. The pill dispensing apparatus is sent to the pharmacy area of the hospital and filled by the pharmacist as per the doctor's order. When the pill dispensing apparatus is ready, it is located bedside. The pill dispensing apparatus eliminates lines of nurses at the Pyxis Machine to pick up the prescribed medication. The medication is delivered bedside, bar coded, packaged, descriptive information, and dated as per Business and Professions Code Section 4070-407B. At the time the medication is dispensed the existing light at the nurses' station alerts the assigned nurse that the proper pills are ready for the patient to take. There are safeguards built into each pill dispensing apparatus that only allow access to the person assigned the machine, there are naturally, ways for the nursing staff to override the system should that be necessary, but unauthorized access by another individual would not be granted with the system.

It has been found that hospital accreditation requirements demand that medications be distributed within a specified window of time. With the cost saving requirements hospitals face today, the staff is usually overworked and faced with fewer bodies to do all the work. The meds nurse is required to get the medications from the supply area check them once and then double check them for each patient distribute them to each individual, assist them in taking the medication should they need help and then do the paperwork for each file. The fact that 98,000 patients die and 770,000 are injured each year due to human error in the present system speaks volumes for the timeliness of the pill dispensing apparatus.

In the home or use other than in the professional setting, each pill dispensing apparatus can hold up to eight prescriptions and should the need arise, can be coupled with a modular system to enlarge the capacity as needed.

The doctor would prescribe the medications and the pharmacy would load the pill dispensing apparatus accordingly. The patient would then take the pill dispensing apparatus home, plug it into the electric current and the apparatus would alert the patient as the medications are dispensed. The pill dispensing apparatus alerts the patient that it is time to take the medications, for example, through up to six difference signaling devices. As a precaution, if the medications are not taken out of the pill collector within an adjustable time frame, such as from 5 minutes to 1 hour, the apparatus automatically dials up to four telephone numbers to alert caregivers to respond to a possible problem.

Prior art in the dispensing of medication had as its design criteria the dispensing of loose pills. With medication compliance now a priority in home, hospital, and care facility the professional code states that medicine administered to the patient must be in a package having a description of the drug, date, strength, bar code, etc. As more and more states adopt new rules the need for a dispensing machine that can handle loose or packaged pills is a must. We have included a system for complying with prescribed medications dosing requirements with safeguards to insure the right pill at the right time. The pill dispensing apparatus has been designed to be as simple as dispensing the correct pill at the correct time or adding numerous further benefits.

A pill dispenser 200 is shown in FIGS. 3A-3D, 3F-3G and 3J-3K. The design of the dispensing cartridge 224 can be a permanent refillable device, or a light plastic throw away piece. The cartridge 224 can be mounted horizontally or vertically and can run either direction to the hopper 225, or put the packaged pill 217 at your fingertips out of slot 214. If desired, pills can be packed at a factory in the cartridge 224 to eliminate the packing and labeling of each pill by the hospital, or care facility. Standardization of packing would cut manufacturing costs for all manufacturers and aid the pharmacy in standard stocking procedures. The pill manufacturer could also prepack a light weight cartridge 224.

A preferred cartridge 224 is a coil feeder cartridge as shown in FIGS. 3A-3D, 3F-3G and 3J-3K. The preferred coil feeder cartridge 224 includes a precision stepper motor 201. The motor 201 drives the coil 211 with coupling 410 and 411 via drive shaft 202 to coil drive 209. The coil 211 is mounted in housing 212. When loose pills are loaded into the cartridge, a pill pushing plate 213 having a coil riding slot 216 can be used to push loose pills 215 in the cartridge 224. The housing 212 includes a pill dispensing slot 214. The housing 212 also contains a coil end support 219, coil end support shaft 220 and end cap 221. This motor 201 is preferably set up to enable precision starting and stopping, and turns the coil 211 exactly one revolution to dispense one pill 217 upon receiving a signal from the controller 30. In the case of a double lead coil 211, one turn would dispense two pills 217. The coil 211 can be right hand, left hand, single or double lead as desired. Examples of suitable feeder coil mechanisms are described in U.S. Pat. Nos. 3,269,595 and 4,061,245, the complete disclosures of which are incorporated herein by reference. While the motor has been shown as being part of the cartridge 224, the motor can be mounted on the pill dispenser 200 and so that the cartridge 224 can easily be made inexpensive and throw-away capable.

Figure 3K:
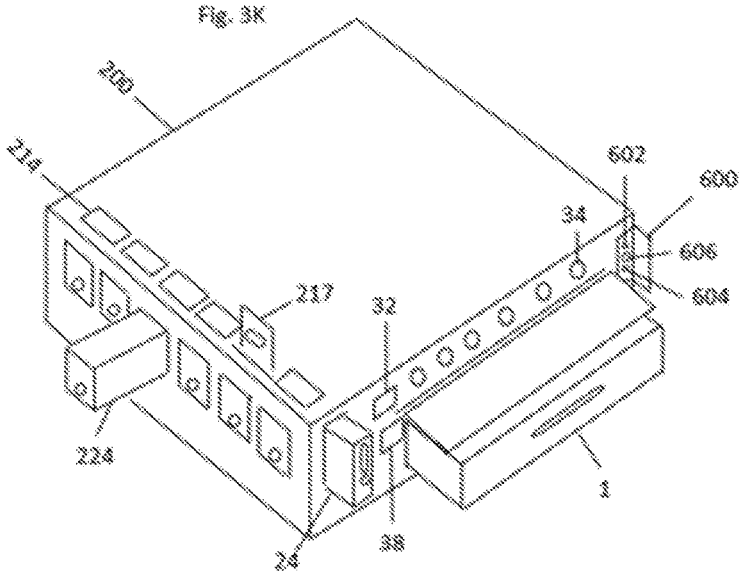
FIGS. 3A-3D, 3F-3H, and 3J-3K illustrate views of a pill dispenser.
Figure 3A:
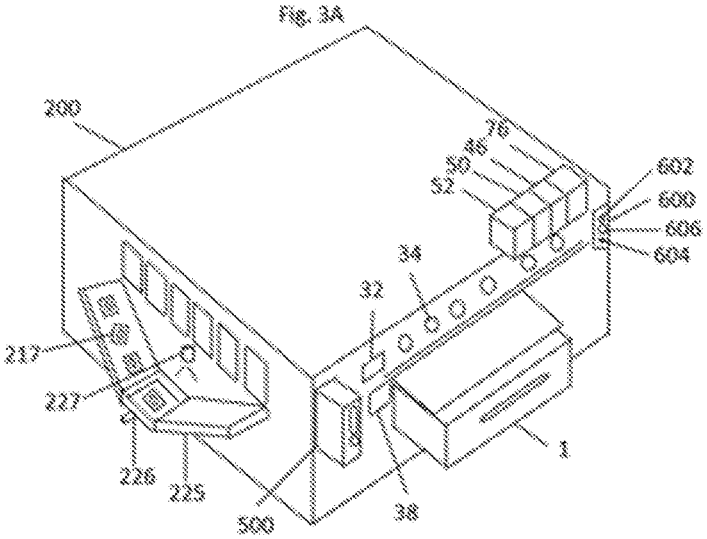
Figure 3F:
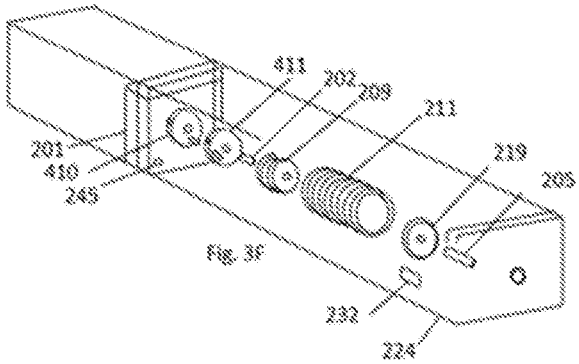
Figure 3G:
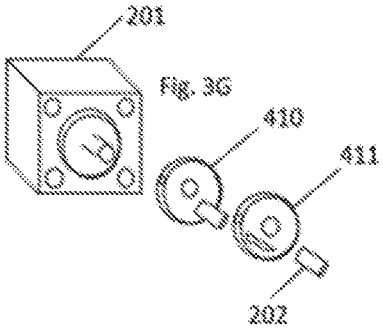
Figure 3J:
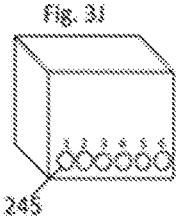
Figure 3H:
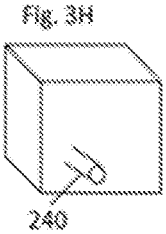
Figure 3E:
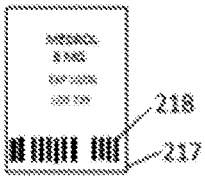
FIG. 3E illustrates a packaged pill.
Figure 3C:
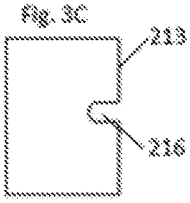
Figure 3B:
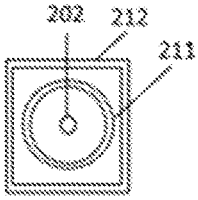
Figure 3D:
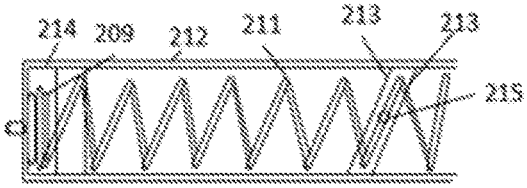

A hospital or pharmacy packaged pill 217 is shown in FIG. 3E. The package includes a description, bar code, and expiration date shown at 218. The cartridge 224 will accept such packaged pill 217.

The pill dispenser 200 is constructed to removably receive at least one cartridge 224. Preferably, the cartridge 224 is keyed, such as a mechanical key, pin 240/245, bolt, wedge or other structure, so that the cartridge 224 can only be placed in the correct location on the pill dispenser 200. The pill dispenser 200 includes a hopper 225 having a funnel shaped bin or dispensing slot 214. All pill(s) 217 dispensed from the cartridge(s) 224 from their respective pill dispensing slots 214 are fed into the hopper 225 that directs the pill(s) to an easy to access pill collector 226 or top of dispenser 214. Collector 226 and top slot 214 are easy to use for the elderly or arthritic.

The pill dispenser 200 can contain a pill dispensed sensor 227 which senses when pill(s) 217 have been dispensed into the collector 226. An example of a pill dispenser sensor 227 is a light beam and photocell (CdS Photo resistor). This pill dispensed sensor 227 can be the switch for the time delay system that alerts the patient to take the pill(s) 217 by sounding an alarm. Alternatively, a drive signal to the cartridge(s) 224 can be used to determine when pill(s) 217 are dispensed.

The pill dispenser 200 contains a pill collector sensor 227 for sensing when the pill collector 226 or dispensing slot 214 is removed from the pill dispenser 200 to confirm that the patient has taken the pill(s) 217.

The pill dispenser 200 or cartridge 224 contains a low pill sensor 232 for sensing when the number of pills in a cartridge 224 is low (including no pills left) or on the last pill. Preferably, the low pill sensor 232 is built into the cartridge 224, such as a small magnetic proximity switch (Reed Switch) as the last pill comes into position it is activated. The low pill sensor 232 can be set so that it is activated when the last pill is dispensed from the cartridge 224.

A pharmacy could load the cartridge 224 and use it as a pill container and place the bar code sticker and the prescription on the cartridge as per the doctor's orders.

The top and front of the pill dispenser are preferably marked, such as with color, numbers, letters, and/or symbols so that a similarly marked cartridge 224 can be removably mounted in the correct location and so that the similarly marked dials control the similarly marked cartridge 224. The markings could also be used to indicate dispensing times as desired, such as one a day morning, three times a day at meals, or every two hours, etc.

A controller 30 for controlling the pill dispenser 200 is shown in FIGS. 1A through 2. The front of the controller 30 is shown in FIG. 1C, alternative back sides are shown in FIGS. 1A and 1B, and FIGS. 2A and 2B. The controller 30 is connected to the pill dispenser 200 using connector 230 and connector 105. Alternatively, the controller 30 and pill dispenser 200 can be built as one unit. The main function of the controller is to control the time and date the pill(s) 217 are dispensed from the pill dispenser 200.

The controller 30 can include as many features as desired, such as the following, which will be described more fully below: a system on light 32, a cartridge is dispensing light 34, a cartridge is dispensing chime 36, cartridge is empty blinking red light emitting diode 38, cartridge is empty buzzer 40, speaker for voice instructions 42, wired voice output 44, wireless transmitter for voice instructions 46, strobe light wired output 48, wireless transmitter for strobe light 50, chime pager wireless transmitter 52, dispensing timer switched 110 AC Volt circuit outlet 54, power inverter for car 56, back up 9 volt battery for timer 58, battery to make controller portable 60, power cord 62, on/off switch 66, security code keypad 67, keyed lock 68, 110 AC Volt outlet 70, automatic phone dialer output 72, printer output 74, wireless transmitter for wristwatch shaker and/or belt shaker 76, and belt shaker 715.

The controller 30 has a timer 1 having six, eight or twelve independent stations. More or less stations can be included as desired. Six stations are shown in FIG. 1A, with each station being defined by a pair of dials 81 and 82, 83 and 84, 85 and 86, 87 and 88, 89 and 90, and 91 and 92. Each station can be set to custom day times when it is convenient for the user. Each pair of setting dials 81-92 are marked to identify a particular cartridge 224, such as by color, numbers, letters, and/or symbols. The pairs of dials are preferably color coded and/or numbered to match a color and/or number on a respective cartridge 224. The pairs of dials also are preferably color coded to match color panels 9 on the front panel 11 marking where each respective cartridge is mounted, as shown in FIG. 1C. Note that FIG. 1C has sufficient color panels 9 for different eight cartridges.

Each dial 81, 83, 85, 87, 89, and 91 has 5 positions representing: off, every day, every other day, every 3.sup.rd day, and every 4.sup.th day. Each dial 82, 84, 86, 88, 90 and 92 has 8 positions representing every day of the week and manual. Between the two dials, the pills can be dispensed every day, every other day, every 3.sup.rd day, every 4.sup.th day, or only on a particular day of the week. This timer setup is only exemplary and more or less controls can be used to set the day schedule.

Once the days are set, the time(s) the pills to be dispensed on each selected day can be set using the time input buttons shown at 4 and display 6. There is no limit to how many times the same or other pills can be dispensed on each selected day. An exemplary setup is as follows:

TABLE-US-00001 Yellow 1 to 5 different pills at 8:00 p.m. or any preset time Orange 3 times a day at meals Red 1 at bedtime Blue 1 every 2 hours for 8 hours Green 1 (4) and (5) every 2 hours for 16 hours White 1 (4), (5) and (6) every 2 hours for 24 hours Any of the above from 5 to 20 days.

The timer 1 can also include a bank of dip switches 10. The switches 10 can be used to combine cartridges 224 to that the timer sees a group of cartridges 224 as one cartridge 224. For example, the yellow station can be set to dispense a pill at particular days and times and the switch 10 set so that multiple cartridges 224 are controlled in unison by the yellow station.

The timer 1 can be equipped with a quick disconnect sub connector so that it can easily be removed or replaced, if desired. The timer can also include an emergency backup battery 58, such a 9 V battery, which can maintain standard times or custom programmed times in case of a power failure. The timer 1 is preferably fused for protection against a power surge. More preferably, the controller 30 contains surge protection circuitry.

The display 6 can maintain current time as well as start times for each station. The timer 1 can have a manual override switch 68, which is preferably turned on with the key switch.

The timer 1 can be programmed at a remote station and then be plugged into the controller 30 and the controller 30 connected to a 110 volt outlet using cord 62. For example, the timer 1 can be programmed from a computer at a nurses station or other for use in the controller 30. Alternatively, the timer 1 can be set after the controller 30 is connected to a 110 volt outlet. When the 110 volt cord 62 is plugged in a red system light 32 can be used to signal that the controller 30 is ready to function. The light 32 remains on as long as the controller 30 is plugged in.

The timer 1 turns on a cartridge 224 by sending a signal to the pill dispenser 200 and the cartridge 224 dispenses a pill(s) 217 into the pill collector 226. The sensor 227 senses that a pill(s) 217 has been dispensed and sends a signal to the controller 30. Alternatively, the signal to the cartridge 224 can be used to identify that a pill(s) 217 has been dispensed. The controller 30 then alerts the patient that a pill(s) 217 has been dispensed and it is time to take the pill(s) 217.

While the timer has been described with reference to a non-computer apparatus, a computer and display 3 as shown in FIG. 1B, such as touchtone display, can be used in place of the dials, display 6, and even the lights 32 and 64, if desired.

After programming the controller 30, it is completely automatic. At the prescribed time the controller 30 sends a signal to activate the cartridge(s) 224 and release the pill(s) 217 and turns on all other functions that have been selected by the doctor, caregiver, or patient. This ensures the patient gets the right pill at the right time.

There are many ways the patient can be alerted that it is time to take the pill(s) 217. For example, at the time the pill(s) 217 is dispensed, an audible signal a piezo buzzer 36 can be used to sound an 80 dB tone at 2900 Hz for a predetermined dispensing time. The controller 30 can also include a voice recording module and speaker 42 to record and play a message such as "take this pill with food" or "take the yellow pill with orange juice" when the pill(s) 217 is dispensed. Alternatively, as shown in FIG. 3A an external speaker device 600 can be used having a record button 602 and play button 604. By holding down the record button 602 and speaking into the speaker 606 in a normal voice the message is recorded. Release the record button 602 to stop recording. Push the play button 604 to change the message by repeating the record process and a new recording replaces the previous one. The message will play when the pill(s) is dispensed. The speaker in the pill dispensing apparatus can be a one-inch speaker with polypropylene cone, which has good sound quality for its size. A variable loudness wired speaker 600 can used if desired for patients who are hard of hearing. The speaker 600 can be connected to the controller 30 using wired voice output 44 and cord 608. The wired voice output 44 can be amplified or not as desired. Alternatively, the speaker 600 can have a wireless connection to the controller 30 using wireless voice transmitter 46 and wireless receiver 610.

For the hard of hearing, as shown in FIG. 7 a strobe light 700, for example, having 100,000 candle power output can be used to provide long-range visibility to notify the patient or caregiver it is time to take the pill(s) 217. The strobe light 700 can be wired to the controller 30 using cord 702 and strobe light wired output 48, or connected via wireless transmitter 50 and wireless receiver 704. For example, flash rates from 110 to 150 times per minute can be used.

When the pill is dispensed, the controller 30 can activate a relay, such as KH style or ice cube style, which powers a standard 110 V house receptacle 54. Any standard 110 V appliance may be connected to the receptacle 54 to signal pill(s) 217 have been dispensed, such as for example a table lamp or radio.

As shown in FIG. 8, a wireless remote pager.720 can be used to signal when a pill(s) 217 has been dispensed. When a pager 720 is to be used, the controller 30 should include a wireless transmitter 52. Typically, the pager 720 can be anywhere within 50 feet of the controller for operation. The pager 720 can be worn on the belt or carried with the patient. The pager 720 usually has audio power of about 80 dB and battery life at six times a day is usually five months.

As shown in FIG. 9, a wristwatch shaker 740 can be used to alert the patient that pill(s) 217 has been dispensed. When the wristwatch 740 or belt shaker 715 is to be used, the controller 30 should include a wireless wristwatch or belt shaker transmitter 76. The length if the signal is adjustable for the patient's own requirement.

For patients who do not pay attention to the pill dispensing notification, the controller 30 is capable of sending an alert to others that pills(s) 217 have not been taken by the patient based on the pill collector sensor 226 not being activated within a predetermined time period after dispensing a pill(s) 217. The controller 30 senses how long the dispensed pill(s) 217 have been in the pill collector 226 by measuring the time from the activation of the pill dispensed sensor 227 or the signal to cartridge 224. At a predetermined length of time the pill(s) 217 have been remaining in the pill collector 226, an automatic telephone dialing system in the controller 30 can notify, for example, up to four phone numbers that the patient has not taken their pills using telephone output 72. The time interval is adjustable in intervals from seconds through 60 minutes, or even longer as desired, so it can be set to handle the patient's needs. Alternatively, an external automatic telephone dialer 400 can be used and connected to the telephone outlet 72 by cord 402. An example of a suitable external automatic telephone dialer is the AT&T #1800 AA automatic telephone dialer that will automatically dial up to four telephone numbers in order of importance, when the time delay instructs it to.

As shown in FIG. 2D, a start-stop timer 900 can be used in the controller 30 for applications needing time intervals from seconds to 60 minutes, or longer. This makes the function of lights, buzzers, pagers, and automatic phone dialers adjustable to the patient's needs.

The controller 30 preferably includes a printer output 74. As shown in FIGS. 5 and 6, a printer 500 is connected to the printer output 74 using cord 502. The printer 500 prints patient's name, room number, or address on sheet 504. Each day paper can be dated and marked with the delivery of each pill. A large machine can be used to record up to 500 patients on card stock for record keeping. The controller 30 can also include a computer output 49 for outputting the patient's name, room number or address, time and type of pill(s) taken, etc. to a computer. The computer output 49 can, for example, be an Ethernet connector, serial or parallel connector, USB connector, modem, or any other device suitable for downloading information to a computer. In this manner, all patient information can be stored in a central location for easy access by doctors.

The controller 30 includes a cartridge empty light 38 and cartridge is empty buzzer 40. When the low pill sensor 232 sends a signal to the controller 30, the controller 30 activates the cartridge empty light 38 and cartridge is empty buzzer 40 until the cartridge 224 is filled or replaced. Instead of the buzzer 40 and light 38, other means for alerting the low pill status of the cartridge 224 can be used, such as a strobe light, speaker, outputting a signal to a computer, etc.

To make the pill dispensing apparatus portable, a 12 V DC car power inverter 56 can be used as shown in FIG. 2B. In this manner, the car becomes the source of power for the pill dispensing apparatus. The 12 V DC vehicle inverter 56 converts car mobile power to 115 VAC.

Another way to make the pill dispensing apparatus portable is to use a battery pack 60 internal or external to the controller 30 as shown in FIG. 2C. A preferred batter is 12 V automotive battery, such as a Die-Hard, or a maintenance free, rechargeable lead-acid battery. These batteries are long life, long service and can be recharged hundreds of times. The electrolyte can immobilized for maintenance free operation.

The timer 1 preferably uses a 9 V battery 58 to take over in the event of a power failure as shown in FIG. 2E. The battery 58 will maintain the memory of the prescribed times and the current time.

The magnetic key card 8 would be activated at the pharmacy with the prescribed time and frequency listed on the prescription. The card reader programs controller 30 with all information for the dispenser 200 and the thermal printer 24. The thermal printer 24 prints out bar codes as well as characters and graphics. Printer 24 would print out patients name, location, doctor's name, prescription No., name of medicine, dosage (e.g. milligrams), pill manufacturer's name, date of manufacture, and expiration date.

The Small c.d. reader 5 would do the same as the magnetic key card 8. The choice would be which one is the most cost effective.

The controller 30 preferably contains a keypad 67 as a safety feature. The twelve key keypad 67 has numerals 0-9 plus * (star) and # (pound). The code can be programmed to a memory chip, like an alarm system code. The code is preferably fed into the controller 30 at the time the timer 1 is programmed. Unless the caretaker changes the timer system the patient gets the pill at the right time. The keypad 67 can be used to override the automatic system and dispense pill(s) 217 by entering the correct code. The keypad 67 can be programmed at the time the dispensing times are set in the timer 1 so the patient cannot change the dose without the doctor or pharmacy changing it.

The pill dispensing apparatus is preferably constructed in a modular system as shown in the attached Figures. In this manner, the pill dispensing apparatus can easily be tailored to needs of a specific patient.

The controller 30 preferably includes a key lock 68 as a safety device to lock 280 all cartridges 224 in place. A caretaker can override the system by punching in the code on keypad 67. When the key 68 s on the red light emitting diode 350 is on so the caretaker knows the cartridge's 224 is locked in place. A caretaker can also override the system by placing a key in the key lock 68 and pushing the respective manual override button 13 and setting the dial 82, 84, 86, 88, 90, or 92 to dispense the correct pill(s) 217. As shown in FIG. 1C, each cartridge has a respective color panel 9, dispensing light 34, and manual override button 13.

A pill container designed for loading directly on to the pill dispensing apparatus in such a way that they cannot be interchanged. All of the cartridges described would. There are advantages and disadvantages to all. Some would require a change in the way pills are now packaged by the pill manufacturer. The changes can be made with a minimum of cost and a maximum of benefits. All cartridges are adaptable to different size pills. I have used as a guide for the largest pill a dimension of 7/16".times.1". The size of the largest pill times the one month supply dictates the size of the cartridge. The cartridge drive system is adaptable to all if the styles. For many hospitals that are seeking accreditation they must now pack their loose pills in a package of 15/8".times.2" and label the package with the contents. These packs are supposed to be opened and described to the patient at the time they are administered. Today the hospital uses a pyxil machine to store medications for the patient.

While the present invention has been described with reference to the preferred coil feeder cartridge 224, other types of cartridges can be used as desired. Examples of other suitable cartridges are described as follows.

A star wheel drive system advances a pill dispensing apparatus cartridge at each system signal an adjustable distance. For example, it can be set at 7/16.437 of an inch based on large pill size of 7/16".times.1". Linear motion of a solenoid or rack and pinion drive is transferred to a star wheel by a threaded rod with self-aligning bushings on each end. A threaded rod is the stroke adjustment rod. The star wheel is mounted on a tube which contains a single direction indicating device. This entire assembly rides on a precision shaft. This system drives the card, belt, flight, large pill, ganged, single or multi-pill, and rack and pinion cartridge.

A tube type cartridge can be used. It can be color coded and have a sight glass for visual inspection. A prescription number can be fastened to the back of the tube. The tube can also be bar coded. After the tube is filled, the pull tab is put in place and held in place with a seal to make it tamper proof. Different size spacers allow for the different size pills. The inserted part of the tube has the keyed slots; these can be ganged in a row for more than one type of pill or multiple pills on the same del time.

A conveyor flight belt cartridge can be used. It can be color coded. It loads in the cartridge the same as the Kodak type. The cartridge can be keyed for correct placement. There is a place for prescription information and bar code. The belt can be white in color and FDA approved. One version is a throwaway type. The other can be reused.

A card can be color coded and fitted within a keyed cartridge, which has a place for the prescription and bar code. There are two styles of this cartridge. In on the pills are held in place with a FDA approved adhesive and removed from the car with a knife type pick. Major pill manufacturers are equipped to do this now, The other style is the same but has a thin clear plastic cover that is rolled off at the time of dispensing. The cartridge holds a month supply of pills.

A belt and tape type cartridge can be used which holds a prepackaged 30-day supply of pills. The cartridge can be color coded and has a place for the bar code and prescription. The cartridge holds the belt or tape much the same way a camera film cartridge holds the film. It is easy to load and the pharmacy would stock the belt or tape pills in large rolls with tear off perforations at 30 pills. The belt or tape type cartridge is actuated by the star wheel drive system.

A rack and pinion cartridge can be used. It can be color coded and have a clear loading cover. The cartridge has two sides. The cartridge can be loaded with two of the same pills or different pills. The cartridge could be made taller to hold multiple pills. The cartridge holds one month supply of pills.

A plunger or slide block system for the pill dispensing apparatus can be used which is operated by the solenoid or rack and pinion drive. It comprises of three chambers. The top chamber is the pill chamber. When the tube type cartridge is placed on the unloading device the first pill rests in the first chamber waiting the signal to the solenoid to dispense. Chamber number two is the sliding chamber which moves forward and backward by the solenoid or rack and pinion. The forward movement aligns the pill with the drop chamber. After the pill has dropped the sliding chamber returns to fill position. This system drives the tube, tube ganged and the plunger cartridge.

A tube type ganged cartridge can be used with sets in a row on top of the pill dispenser allowing two, three, or four tubes in a row, each holding a 30-day supply of pills. A single signal from the pill dispensing apparatus dispenses one, two, three, or four pills at a time.

A belt, tape, flight, single, multi-pill cartridges can be used and mounted side by side. They are designed to unload the first cartridge and then engage the next cartridge with an indexing pin. This type would need three ganged to dispense three pills a day for one month.

An extra-large pill cartridge can be used which is the same size as the standard, single, or multi-pill cartridge. It has an inner and outer chamber. Then the outer chamber is empty the indexing pin starts the inner chamber and drives until the last pill is dispensed.

Preferably, if different pill cartridges are used, the cartridges and pill dispenser are constructed such that they cannot be interchanged. There are advantages and disadvantages to all of the cartridges. Some would require a change in the way pills are now packaged by the pill manufacturer. The changes can be made with a minimum of cost and a maximum of benefits. All cartridges are adaptable to different size pills. I have used as a guide for the largest pill a dimension of 7/16".times.1". The size of the largest pill times the one month supply dictates the size of the cartridge. The cartridge drive system is adaptable to all if the styles. For many hospitals that are seeking accreditation they must now pack their loose pills in a package of 15/8".times.2" and label the package with the contents. These packs are supposed to be opened and described to the patient at the time they are administered. Today the hospital uses a Pyxil machine to store medications for the patient.

The operations described in Figs. and herein can be implemented as executable code stored on a computer or machine readable non-transitory tangible storage medium (e.g., floppy disk, hard disk, ROM, EEPROM, nonvolatile RAM, CD-ROM, etc.) that are completed based on execution of the code by a processor circuit implemented using one or more integrated circuits; the operations described herein also can be implemented as executable logic that is encoded in one or more non-transitory tangible media for execution (e.g., programmable logic arrays or devices, field programmable gate arrays, programmable array logic, application specific integrated circuits, etc.).

In the description, for purposes of explanation and not limitation, specific details are set forth, such as particular networks, communication systems, computers, terminals, devices, components, techniques, storage devices, data and network protocols, software products and systems, operating systems, development interfaces, hardware, etc. in order to provide a thorough understanding of the present invention. However, it will be apparent to one skilled in the art that the present invention may be practiced in other embodiments that depart from these specific details. Detailed descriptions of well-known networks, computers, digital devices, storage devices, components, techniques, data and network protocols, software products and systems, development interfaces, operating systems, and hardware are omitted so as not to obscure the description of the present invention.

Figure 12:
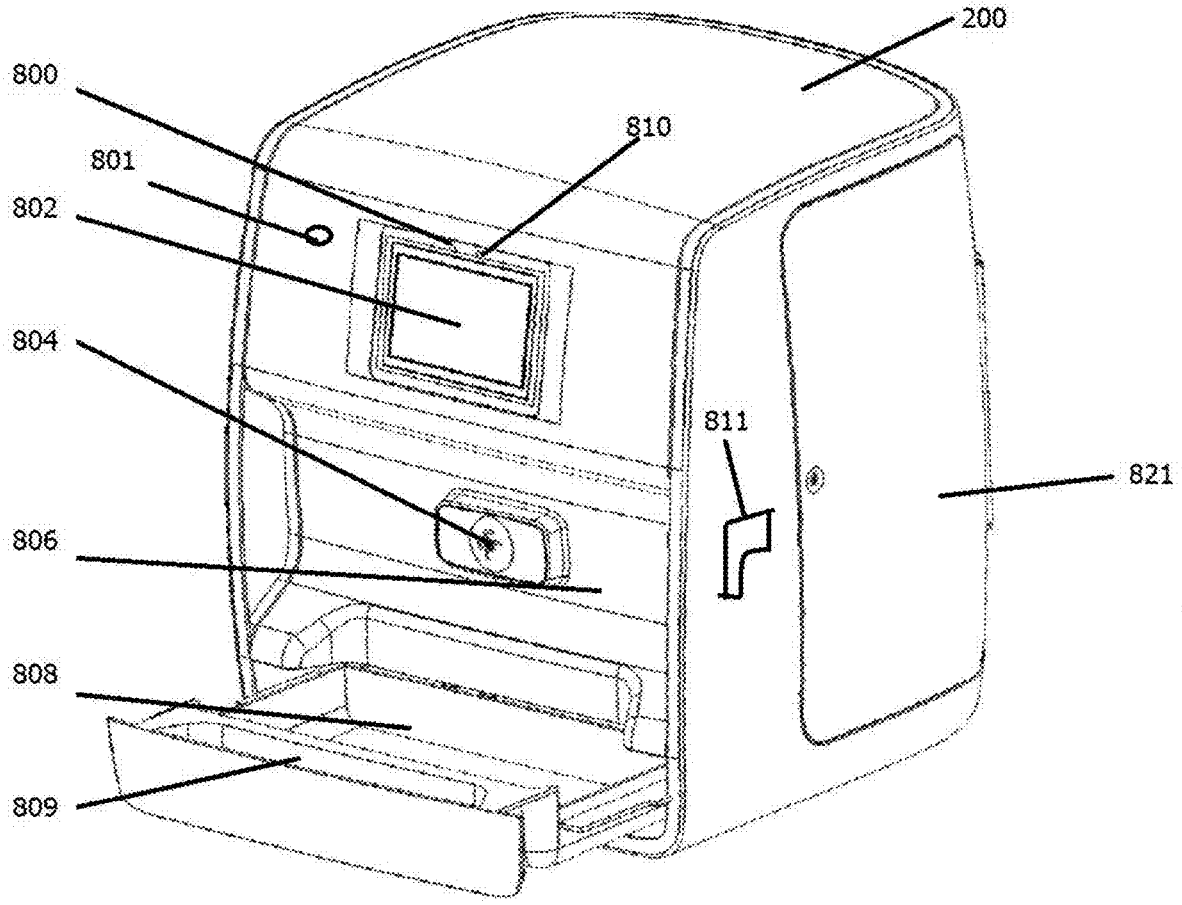
FIG. 12 illustrates a front view of a pill dispenser.
Figure 13:
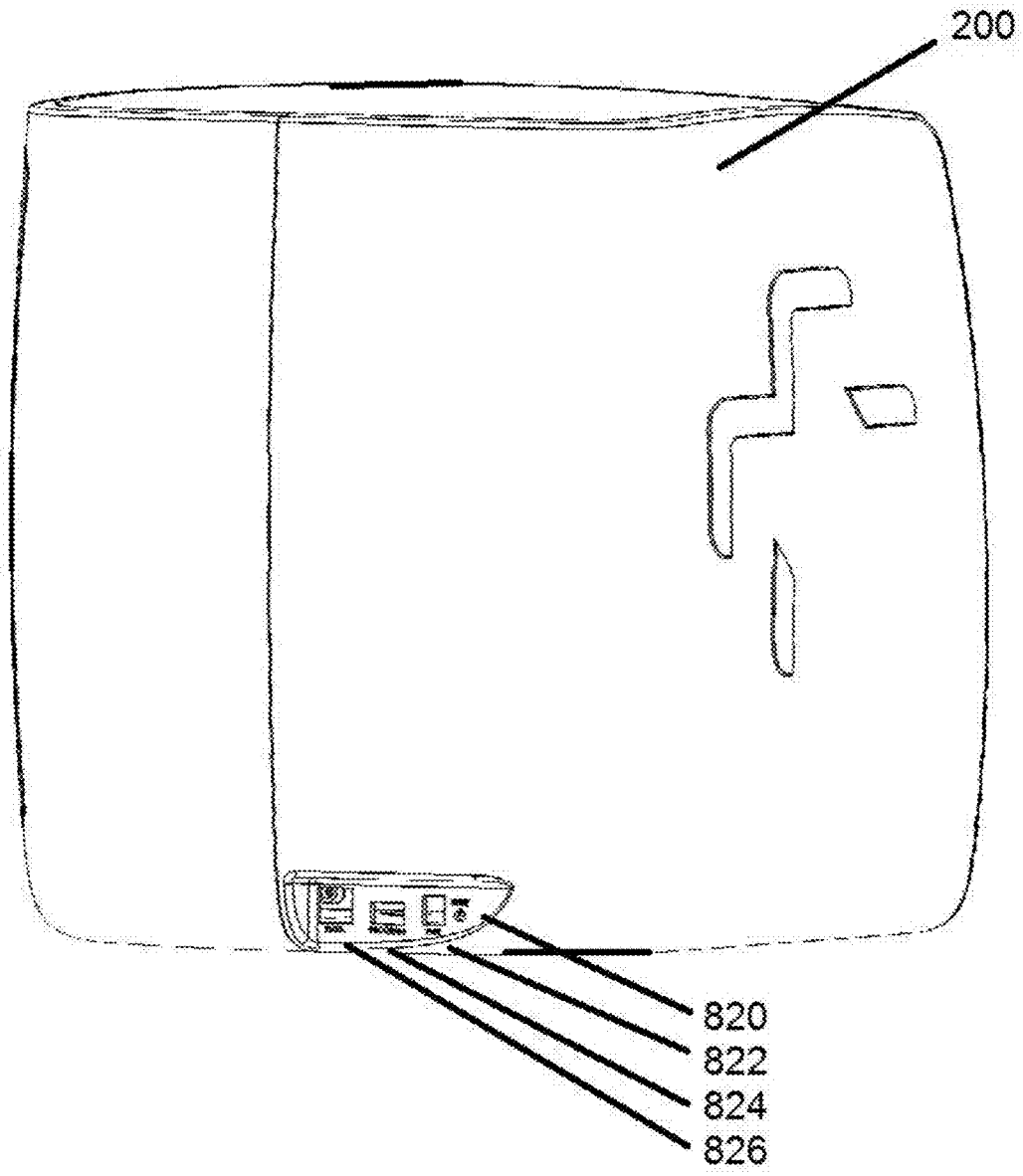
FIG. 13 illustrates a back view of a pill dispenser.
Figures 14A, 14B:
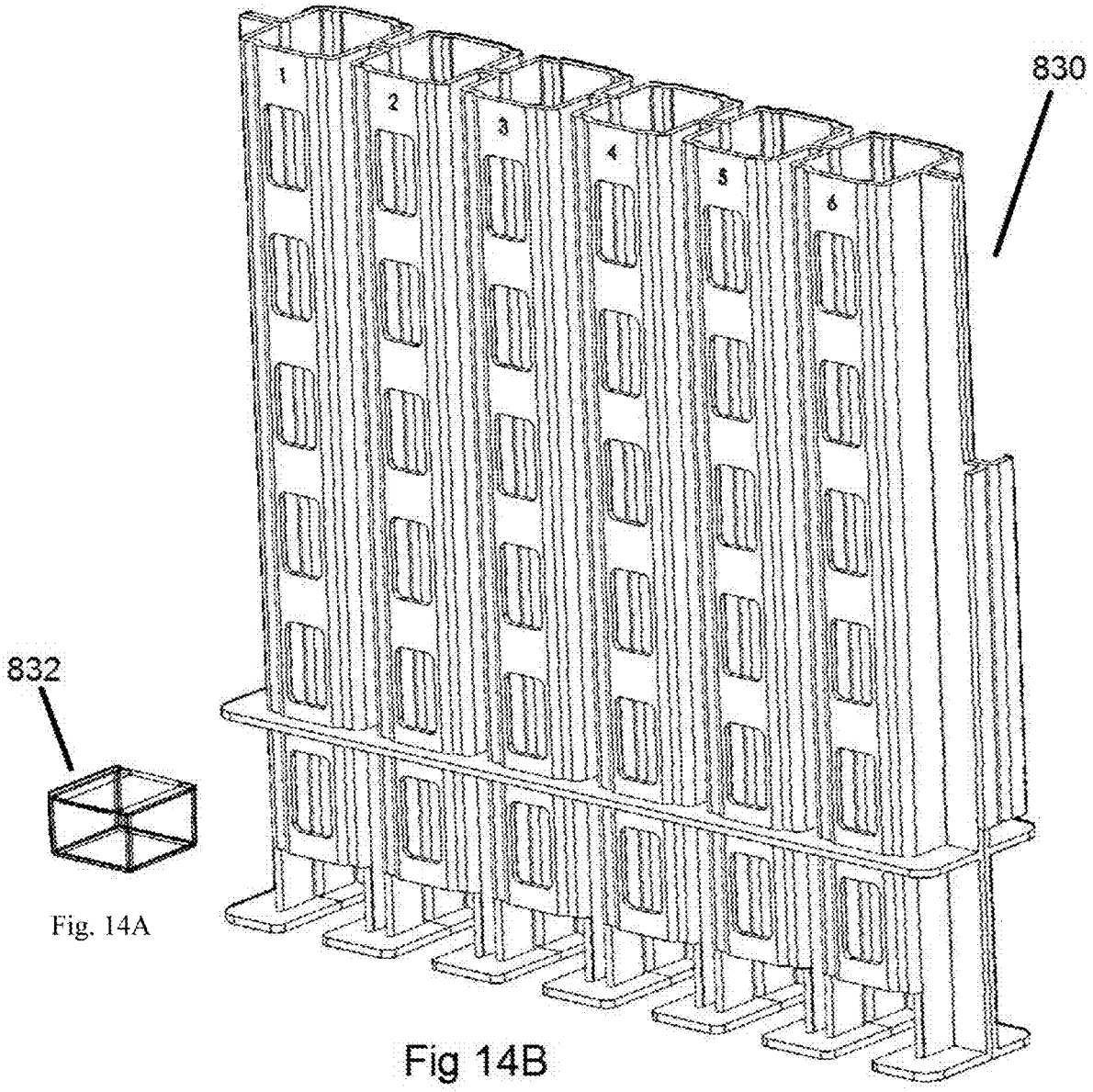
FIGS. 14A and 14B illustrate a cartridge.
Figure 15:
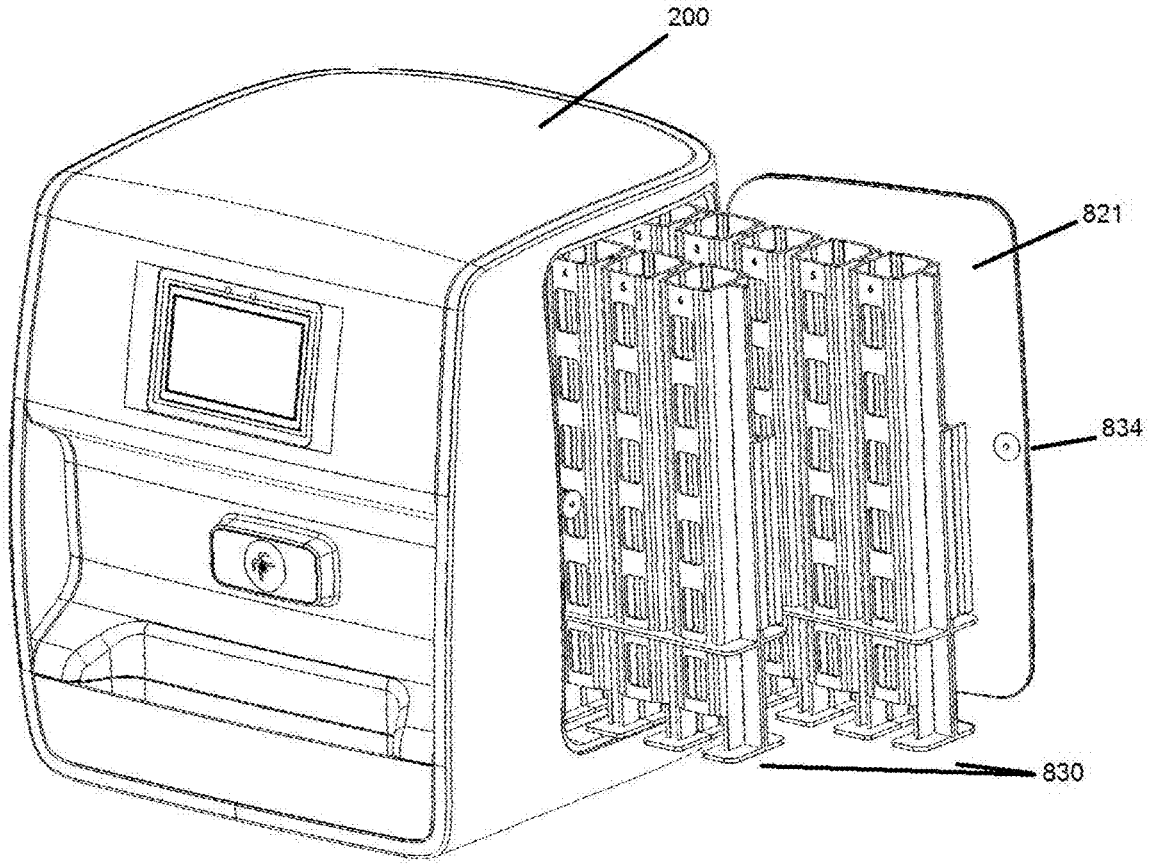
FIG. 15 illustrates a view of a pill dispenser with a cartridge being loaded.
Figure 16:
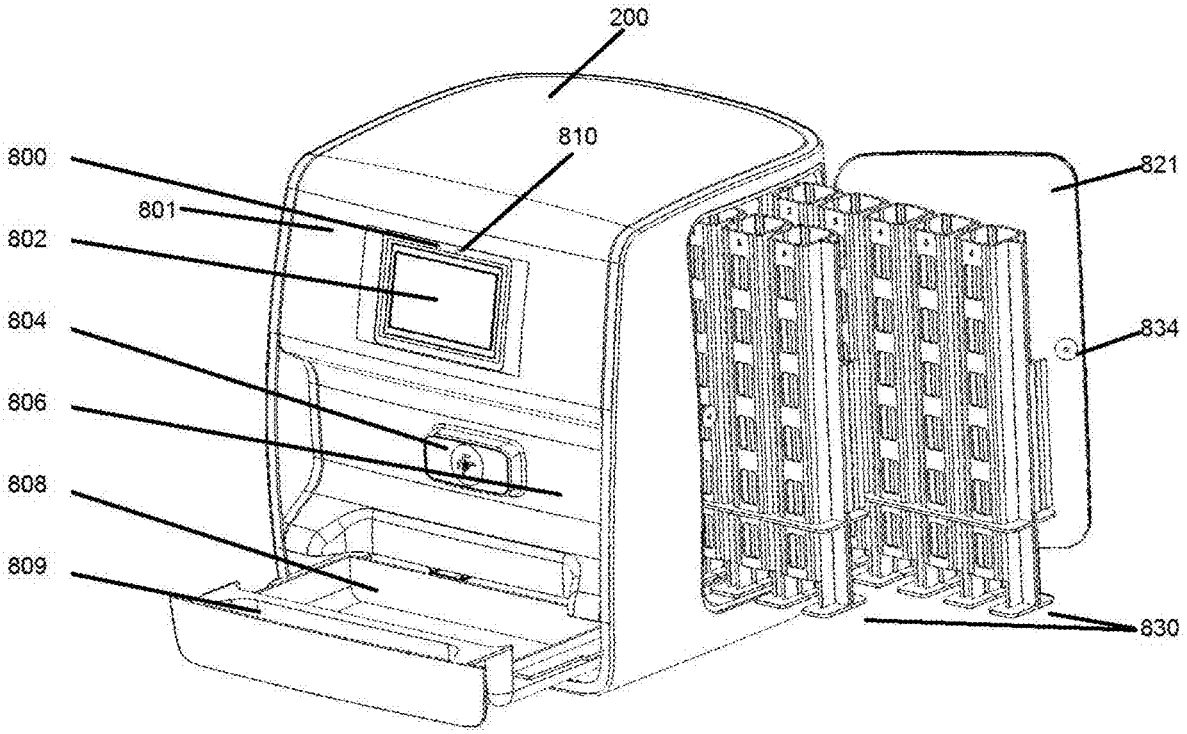
FIG. 16 illustrates a view of a pill dispenser with a cartridge being loaded.

FIG. 12 illustrates a front view of a pill dispenser apparatus 200. FIG. 13 illustrates a back view of a pill dispenser apparatus 200. FIGS. 14A and 14B illustrate a cartridge and medication. FIG. 15 illustrates a view of a pill dispenser with a cartridge being loaded. FIG. 16 illustrates a view of a pill dispenser with a drawer open.

The apparatus 200 has a display 802 for displaying information. The display 802 can be a touch screen for entering information into the apparatus 200. The apparatus 200 includes a processor, non-volatile, non-transitory memory, user input and user output mechanisms, a network interface, a database and executable program code (software) comprising computer executable instructions stored in non-transitory tangible memory that executes to control the operation of the apparatus 200 and display 802.

A camera 800 is provided on the apparatus 200 to capture pictures and/or video of the user taking a pill, which can be stored in the memory. A flash device 810 can be constructed to light the user for improved pictures and/or video from the camera 800. A date and time stamp can be included on photos or video captured by the camera 800. The dispensing switch/button 804 that opens the dispensing drawer 808 to dispense the medication can be constructed so that the dispensing button 804 will not operate until the camera 800 captures a photo or video of the user with a date and time stamp to ensure that the medication was taken and also to prevent too much medication being taken. The button 804 can be backlight so that the button 804 can be lit to signal that medication should be taken. The dispensing drawer 808 can include a slot 809 for needles and inhalers. The dispensing drawer 808 can also include a locking mechanism. The apparatus 200 can include a water dispenser 811 and source of water such as a faucet hookup or water reservoir.

Figure 17:
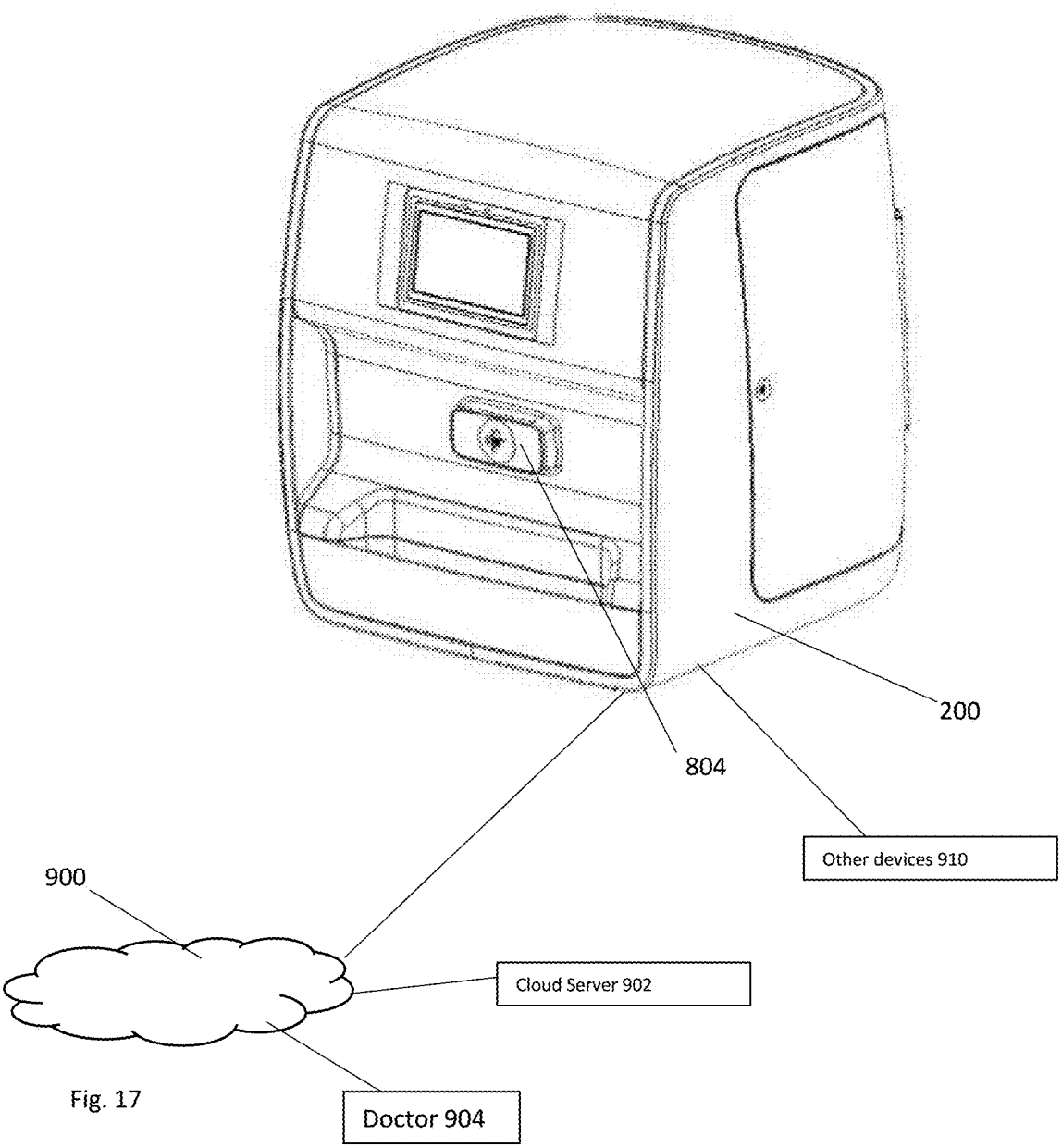
FIG. 17 illustrates a flow chart of an exemplary operation of the apparatus.

FIG. 17 describes an example of an apparatus 200 connected to a doctor or nurse using a user interface device 904 and a server 202 through a network 900. All connections can be direct, indirect, wireless and/or wired as desired. FIG. 13 shows a reset button 820, a power connection 822, a USB port 824, and an RJ45 port 826. Examples of the network 900 are the telephone network or internet. A doctor, nurse or other healthcare practitioner can use the user interface device 904 to remotely program the apparatus 200, such as setting the timer remotely. Alerts can be sent from the apparatus 200 to the user interface device 904, such as when medication has been dispensed from the apparatus or when a time limit for dispensing the medication has passed. Information regarding when the door has been opened or about other functions of the apparatus 200 can be sent to the user interface device 904 and/or server.

The display 802, camera 800 and microphone 801 can be used to provide video conferencing with the user interface device 904. Text messaging can also be conducted between the display 802 and the user interface device 904. Configurations of the connections, texting, messaging, or any other function of the apparatus 200 can be conducted using the display 802 or network connections to access the computer programming. Network availability and whether connected can be displayed on the display 802. Type of medication, amount of medication left in the cartridge, amount dispensed, and any other information can be displayed on the display 802 and/or transmitted to the server 202 or user interface device 904. The apparatus 200 can be programmed to provide an administrator screen on the display 802 so that the administrator can access functions of the apparatus not accessible by the user. The administrator screen can be protected by a password.

The display 802 can display a clock, network and battery status, or any other desired information when the apparatus 200 is idle. An alarm 806, can be provided. The alarm can be a voice recorded message, a music file, or any other sound, a vibration, or a visible light. At a scheduled alarm time, the apparatus 200 can flash the button LED, display alarm information and/or play audio waiting for the button 804 to be pressed. When the button 804 is pressed the camera 800 can capture a camera image and the apparatus 200 can prepare to dispense medication. When the apparatus drawer 808 is open, the apparatus 200 can require the drawer 808 to be closed before completing action. The apparatus 200 can allow for an optional PIN to dispense medication. After the apparatus 200 is ready to dispense medication, the apparatus 200 can display a message to open the drawer 808 on the display 802. The apparatus 200 can allow for non-dispense alarms with custom caregiver messages displayed on the display 802. The apparatus alarm can play a voice recorded message, music or other sound as desired. An alarm for late dispensing can be stopped by pressing the button 804 and taking the medication. If the drawer 808 is not opened or the non-dispense message is not acknowledged, the event will be considered not completed. All event outcomes can be communicated from the apparatus 200 to the server 902 and/or user interface device 904 via the network 900. The apparatus 200 can communicate missed dispenses to the server 902 and/or user interface device 904 after an amount of time specified by an administrator, which for example can be a healthcare provider, doctor, or nurse. Apparatus software updates can be done at the location by the server 902 transmitting the update to the apparatus 200 via the network 900. The apparatus 200 can be programmed to not display software update notifications. The apparatus 200 can have an administrator menu for configuration of the apparatus 200. The apparatus administrator menu can require a PIN for access. If a PIN is incorrectly entered 3 times a message can be sent from the apparatus 200 to the server 902. The apparatus 200 can be charged by USB and/or powered by a power outlet, or any other desired power source.

Various networks 900 may be implemented in accordance with embodiments of the invention, including a wired or wireless local area network (LAN) and a wide area network (WAN), wireless personal area network (PAN) and other types of networks that comprise or are connected to the Internet. When used in a LAN networking environment, computers may be connected to the LAN through a network interface or adapter. When used in a WAN networking environment, computers typically include a modem, router, switch, or other communication mechanism. Modems may be internal or external, and may be connected to the system bus via the user-input interface, or other appropriate mechanism. Computers may be connected over the Internet, an Intranet, Extranet, Ethernet, or any other system that provides communications, such as by the network 140. Some suitable communications protocols may include wifi, TCP/IP, UDP, OSI, Ethernet, WAP, IEEE 802.11, Bluetooth, Zigbee, IrDa, WebRTC, or any other desired protocol. Furthermore, components of the system may communicate through a combination of wired or wireless paths, including the telephone networks. The communications can be encrypted.

An exemplary user interface device 904 contains a web browser and display. This includes user interface devices 904 such as internet connected televisions and projectors, tablets, iPads, Mac OS computers, Windows computers, e-readers, and mobile user devices such as the smartphones, iPhone, Android, and Windows Phone, and other communication devices. Preferably, the user interface device 904 is a television, tablet or smartphone. The smartphone can be in any form, such as a hand held device, wristband, or part of another device, such as vehicle. The user interface devices 904 can connect to the server 902 or apparatus 200 via the network 900.

The server 902 described herein can include one or more computer systems directly connected to one another and/or connected over the network 900. Each computer system includes a processor, non-volatile, non-transitory memory, user input and user output mechanisms, a network interface, a database and executable program code (software) comprising computer executable instructions stored in non-transitory tangible memory that executes to control the operation of the server 902. Similarly, the processors functional components formed of one or more modules of program code executing on one or more computers. Various commercially available computer systems and operating system software can be used to implement the hardware and software. The components of each server can be co-located or distributed. In addition, all or portions of the same software and/or hardware can be used to implement two or more of the functional servers (or processors) shown. The server 902 can run any desired operating system, such as Windows, Mac OS X, Solaris or any other server based operating systems. Other embodiments can include different functional components. Preferably, the server 902 is a cloud based computer system.

The server 902 includes at least one web server and the query processing unit. The server 902 can include a website accessible by the network 900. The web server receives the user query and sends it to the query processing unit. The query processing unit processes the user query and responds back to the user interface device 904 and the apparatus 200 via the web server. Multiple apparatuses 200 and user interface devices 904 can be connected to the server 200. The query processing unit fetches data from the database if additional information is needed for processing the user query. The database can be stored in the non-volatile, non-transitory memory. The term "database" includes a single database and a plurality of separate databases. The server 902 can comprise the non-volatile, non-transitory memory or the server 902 can be in communication with the non-volatile, non-transitory memory storing the database. The database can be stored at different locations.

Other devices can connect to the apparatus 200 using the network 900, directly or wireless such as wifi or Bluetooth. Other devices can include, but not limited, monitors such as blood pressure, heart rate, or temperature. The information from the other devices can be utilized by the apparatus 200 and/or transmitted to the user interface device 904 or server 902 via the network 900.

Software programs can be stored in the non-transitory, non-volatile memory of the server 902 and in the non-transitory, non-volatile memory of the apparatus 200. The software and databases can be stored using any data structures known in the art including files, arrays, linked lists, relational database tables and the like. The server 902 and/or apparatus 200 can be programmed to perform the processes described herein.

For example, the packages can be sized to store up to 10 medications per dose package 832. The dose packages can be arranged in cartridge slots 830 to daily timed dispenses for any desired period, such as 7 or 14 days. The dose packages can be aligned in such a manner that dose packages can be dispensed one time per day for each of the cartridge slots. Any desired number of cartridge slots can be utilized, such as six shown in the Figs. The cartridges 830 can be sized as desired. For example, one cartridge 830 can be capable of holding a two week supply of dose packages. Any number of desired cartridges 830 can be present in the apparatus 200. For example, a second cartridge 830 can be located in the apparatus 200 to have the capability of holding a second two week supply of dose packages making the dispenser capable of holding a four week supply of dose packages for a total of one hundred sixty eight dispensed dosed packages. The apparatus 200 can have a cartridge enclosure door 821 that can be locked by the lock 834.

Figure 18:
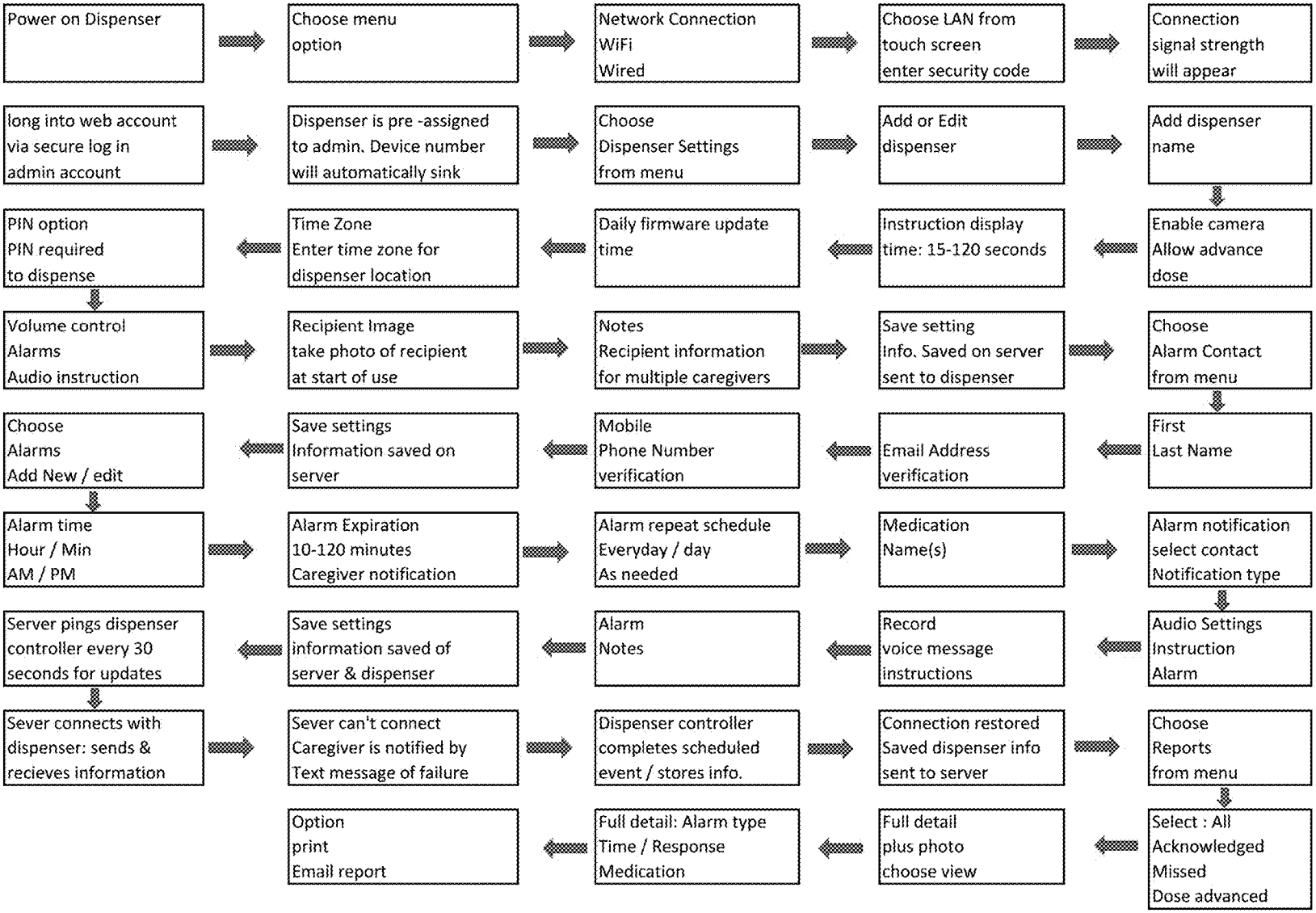
FIG. 18 illustrates a exemplary apparatus connected to the internet.

FIG. 18 illustrates an exemplary flow chart of operation of the apparatus.

While the claimed invention has been described in detail and with reference to specific embodiments thereof, it will be apparent to one of ordinary skill in the art that various changes and modifications can be made to the claimed invention without departing from the spirit and scope thereof.

The invention claimed is:

1. A packaged pill dispensing apparatus comprising:

at least one cartridge constructed and arranged to dispense individually packaged pills;

a packaged pill dispenser constructed and arranged to removably receive at least one cartridge, the packaged pill dispenser having a dispensing drawer constructed and arranged to collect individually packaged pills dispensed from the at least one cartridge;

a low pill sensor constructed and arranged to sense a number of individually packaged pills remaining in the cartridge;

a pill collector sensor constructed and arranged to signal when a patient has removed the individually packaged pill from the dispensing drawer a controller constructed and arranged to control the rate and number of the individually packaged pills to be dispensed from the at least one cartridge to the dispensing drawer, the controller comprising a timer having inputs for inputting the day and time of day for dispensing the individually packaged pills from the cartridge;

a camera connected to the controller and configured to capture pictures or video of the patient removing the individually packaged pill from the dispensing drawer; and a touch display connected to the controller for allowing user interface with the device.

2. The pill dispensing apparatus according to claim 1, wherein the dispensing drawer includes a locking mechanism.

3. The pill dispensing apparatus according to claim 1, wherein the individually packaged pill is dispensed from the at least one cartridge into the dispensing drawer when the user opens the dispensing drawer.

4. The pill dispensing apparatus according to claim 1, further comprising a PIN dispensing lock.

5. The pill dispensing apparatus according to claim 1, wherein dose packages are arranged in cartridge slots to daily timed dispenses for a period of 14 days.

6. The pill dispensing apparatus according to claim 1, further comprising six (6) cartridges, wherein dose packages are aligned in such a manner that dose packages can be dispensed one (1) time or more per day for each of the six (6) cartridges.

7. The pill dispensing apparatus according to claim 1, wherein one (1) cartridge is capable of holding a two 14 dose packages.

8. The pill dispensing apparatus according to claim 1, further comprising a second cartridge, wherein the at least one cartridge and the second cartridge each can hold a two (2) week supply of dose packages making the dispenser capable of holding a four (4) week supply of dose packages for a total of one hundred sixty eight (168) dispensed dosed packages.

9. The pill dispensing apparatus according to claim 1, further comprising a cartridge enclosure door that can be locked.

10. A method of automatically dispensing packaged pills comprising:

loading at least one cartridge with packaged pills, the cartridge constructed and arranged to dispense the packaged pills, wherein the pills are individually packaged;

installing the cartridge containing the individually packaged pills onto a pill dispenser constructed and arranged to removably receive the cartridge, the pill dispenser having a dispensing drawer constructed and arranged to collect the individually packaged pills dispensed from the at least one cartridge, a low pill sensor constructed and arranged to sense a number of individually packaged pills remaining in the cartridge, and a pill collector sensor constructed and arranged to signal when a patient has removed an individually packaged pill from the dispensing drawer;

setting a timer on a controller using a touchscreen to control the rate and number of the individually packaged pills to be dispensed from the at least one cartridge to the dispensing drawer, the controller being in communication with the low pill sensor, the controller being in communication with the pill collector sensor;

alerting a patient when the individually packaged pill has been dispensed into the dispensing drawer;

taking a picture or video of the patient when the patient removes the packed pill from the dispensing drawer;

providing an alert when the dispensed individually packaged pill has not been removed from the dispensing drawer after a set time period; and providing an alert when the number of individually packaged pills remaining in the cartridge is low or on last pill.

11. The method according to claim 10, wherein the dispensing drawer includes a locking mechanism.

12. The method according to claim 10, wherein the pill is dispensed when the user opens the dispensing drawer.

13. The method according to claim 10, wherein the pill dispenser provides the ability for a PIN dispensing lock.

14. The method according to claim 10, further comprising a non-dispense alarm with a custom caregiver messages.

15. The method according to claim 10, wherein dose packages are arranged in cartridge slots to daily timed dispenses for a period of 14 days.

16. The method according to claim 10, wherein dose packages are aligned in such a manner that dose packages can be dispensed one (1) time per day for each of the six (6) cartridge slots.

17. The method according to claim 10, wherein one (1) cartridge is capable of holding a two (2) week supply of dose packages.

18. The method according to claim 10, further comprising a second cartridge, wherein the at least one cartridge and the second cartridge each hold a two (2) week supply of dose packages making the dispenser capable of holding a four (4) week supply of dose packages for a total of one hundred sixty eight (168) dispensed dosed packages, and the method further comprising dispensing dose packages for four weeks.

19. The method according to claim 10, further comprising a cartridge enclosure door and the method further comprising locking the enclosure door.

* * * * *